United States Patent [19]

Calfus

[11] Patent Number: 4,862,866

[45] Date of Patent: Sep. 5, 1989

[54] CIRCUIT FOR THE PILOTING OF INDUCTIVE LOADS, PARTICULARLY FOR OPERATING THE ELECTRO-INJECTORS OF A DIESEL-CYCLE INTERNAL COMBUSTION ENGINE

[75] Inventor: Marco Calfus, Turin, Italy

[73] Assignee: Marelli Autronica S.p.A., Milan, Italy

[21] Appl. No.: 235,861

[22] Filed: Aug. 22, 1988

[30] Foreign Application Priority Data

Aug. 25, 1987 [IT] Italy ..... 6730 A/87

[51] Int. Cl.[4] ..... F02M 51/00

[52] U.S. Cl. ..... 123/490; 361/155

[58] Field of Search ..... 123/490, 90.11; 361/93, 361/101, 155; 323/285

[56] References Cited

U.S. PATENT DOCUMENTS

| | | | |
|---|---|---|---|
| 3,665,901 | 5/1972 | Monpetit et al. | 123/490 |
| 3,942,485 | 3/1976 | Suda et al. | 123/490 |
| 4,589,401 | 5/1986 | Karion et al. | 123/490 |
| 4,607,311 | 8/1986 | Brown et al. | 123/490 |
| 4,639,822 | 1/1987 | Kubach et al. | 123/490 |
| 4,665,459 | 5/1987 | Byrun et al. | 123/490 |
| 4,706,619 | 11/1987 | Bachl | 123/490 |
| 4,753,207 | 6/1988 | Wright | 123/490 |

*Primary Examiner*—Raymond A. Nelli

*Attorney, Agent, or Firm*—Sughrue, Mion, Zinn, Macpeak & Seas

[57] ABSTRACT

A piloting circuit for inductive loads, particularly for operating the electro-injectors of a diesel engine, comprises an input for connection to a low tension supply, a storage coil for storing energy delivered by the supply, and electronic switching devices for controlling the connection between the input, the storage coil and each of the loads in a predetermined manner to achieve a rapid transfer of current each of the loads selectively a capacitor situated in parallel with the branch circuits containing the loads and connected to the coil and the electronic switching devices, and an electronic control unit. The electronic control unit pilots the electronic switching devices according to a first operative mode in which, to transfer current to one of the loads, the switching devices cause in succession, after the connection the storage coil to the supply, the connection of the storage coil to the capacitor so as to form a resonant circuit, and then the discharge of the resonant circuit into the load.

10 Claims, 4 Drawing Sheets

Figure 1:
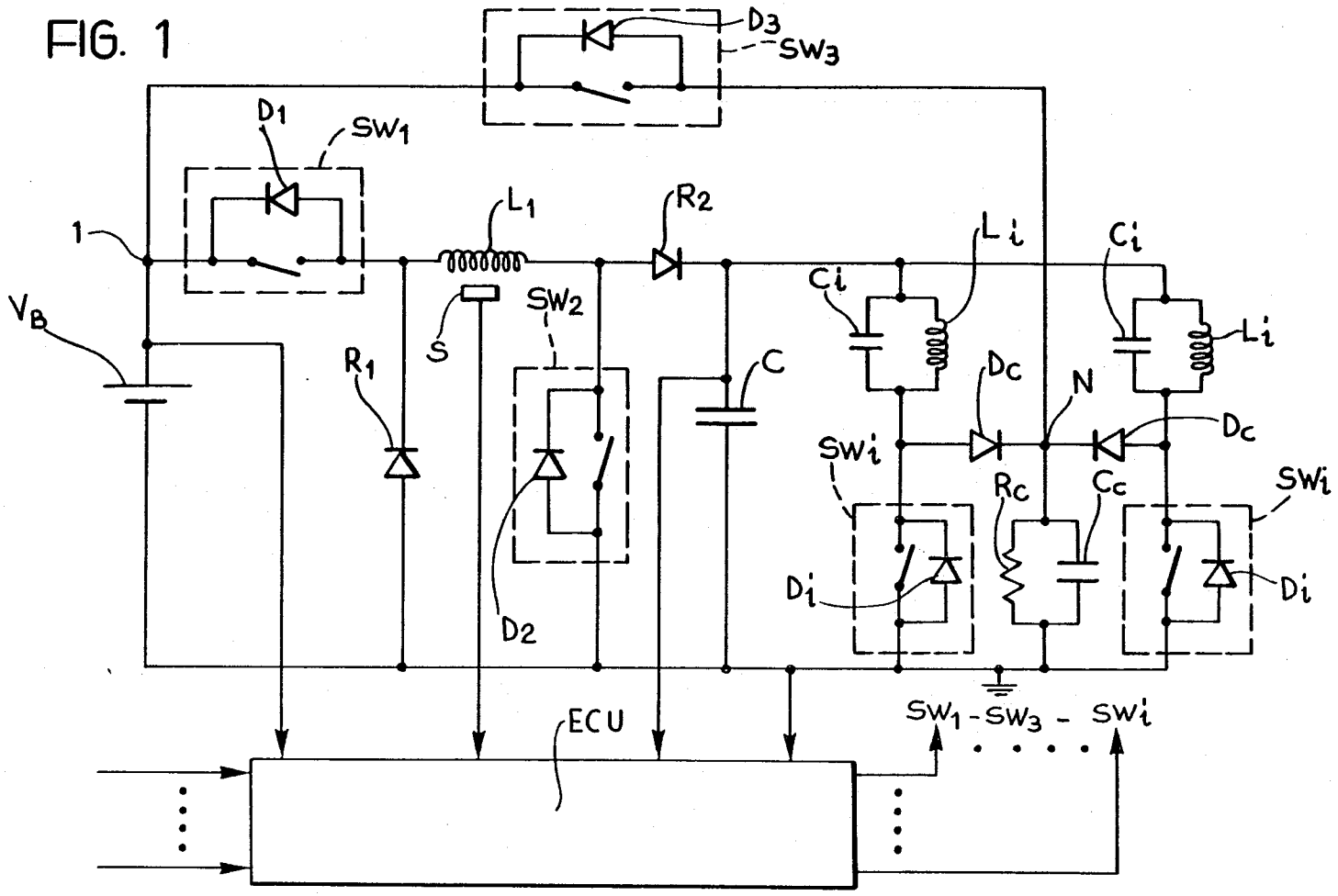

$I_{Li}$
$I_{MAX}$
a
b
c
d
e
f
$I_{Li}$
$I_H$
t $I_{Li}$
$I_{MAX}$
$I_H$
$t_0$
$t_1$
$t_2$
$V_C$
$t_2$
$SW_i$
OFF
ON
$t_0$
$t_1$
$t_2$
$t_3$
$SW_3$
OFF
ON
$t_0$
$t_1$
$t_2$
$t_3$

CIRCUIT FOR THE PILOTING OF INDUCTIVE LOADS, PARTICULARLY FOR OPERATING THE ELECTRO-INJECTORS OF A DIESEL-CYCLE INTERNAL COMBUSTION ENGINE

DESCRIPTION

The present invention relates to a circuit for the piloting of inductive loads, and particularly for the control of the electro-injectors of a diesel-cycle internal combustion engine.

More specifically, the subject of the invention is a circuit comprising:

an input for connection to a low-tension supply, a storage coil for storing energy delivered by the supply, and electronic switching means for controlling the connection between the input, the storage coil and the loads in a predetermined manner to achieve a rapid transfer of current to each of the loads selectively.

A circuit of this type is described in Italian patent application No. 67953-A/85. This known circuit comprises a plurality of branch circuits, in each of which a capacitor is connected in parallel with an inductive load and forms a resonant circuit with the load. The rapid transfer of current to each of the loads is achieved by first storing energy delivered by the supply to the storage coil and then connecting the storage coil to the resonant circuit including the load to be activated.

Solenoids for operating the electro-injectors for diesel engines represent non-linear inductive loads of relatively small inductance. Consequently, with the known circuit described above, it is only possible to transfer sufficient energy to such loads if capacitors of good quality and high capacitance, which are therefore bulky and expensive, are used in parallel with the loads.

An object of the present invention is to produce a circuit for controlling inductive loads of the type defined above, which enables a large amount of energy to be transferred rapidly to the load selected from time to time, without requiring the use of a plurality of large and expensive capacitors.

According to the invention, this object is achieved by means of a circuit of the type specified above, whose main characteristic lies in the fact that it also includes:

a capacitor arranged in parallel with the branch circuits containing the loads, and connected to the storage coil and the electronic switching means, and an electronic control unit for piloting the electronic switching means in a first operative mode in which, to transfer current to one of the loads, the switching means, after having connected the storage coil to the supply, connect the coil to the capacitor so as to form a resonant circuit and then discharge the resonant circuit into the load.

In the circuit according to the invention, as in the known circuit, a capacitor may be connected in parallel with each load to enable the current to be cancelled out rapidly when the load is deactivated. In the prior-art circuit described above, this capacitor is represented by the same large-capacitance capacitor used for the transfer of current to the load. In the circuit according to the invention, any quenching capacitor connected in parallel with each load has a much smaller capacitance than that of the capacitor used for transferring current to the load selected from time to time.

When the circuit according to the invention is used for piloting the injectors of a diesel engine, the supply is typically constituted by the battery of the motor vehicle. In some circumstances, this battery is unable to deliver a sufficiently high current for the piloting circuit to be able to energise the electro-injectors in the desired manner. This may occur, for example, when the battery is not sufficiently charged or when, for various reasons, the impedance "felt" by the battery is unusually high. In such a situation, the prior-art circuit described above is unable to pilot the electro-injectors in a satisfactory manner.

A further object of the present invention is to produce a circuit of the type specified above which is able to ensure the correct functioning of the electro-injectors even when the supply is unable to deliver a current of sufficiently high intensity.

This object is achieved according to the invention by means of a circuit of the type specified above, characterised in that it also includes sensor means for supplying electrical signals indicative of the current delivered by the supply, and in that the electronic control unit is connected to the sensor means and is arranged to pilot the electronic switching means in the first operative mode and in a second operative mode when the current delivered by the supply is greater than and less than a predetermined level, respectively, the control unit being able, in the second operative mode, to cause:

the connection of the capacitor to the supply through voltage-boosting means, so as to charge the capacitor to a predetermined voltage level which is greater than the supply voltage, and then the discharge of the energy stored in the capacitor to the load selected from time to time.

Figure 2:
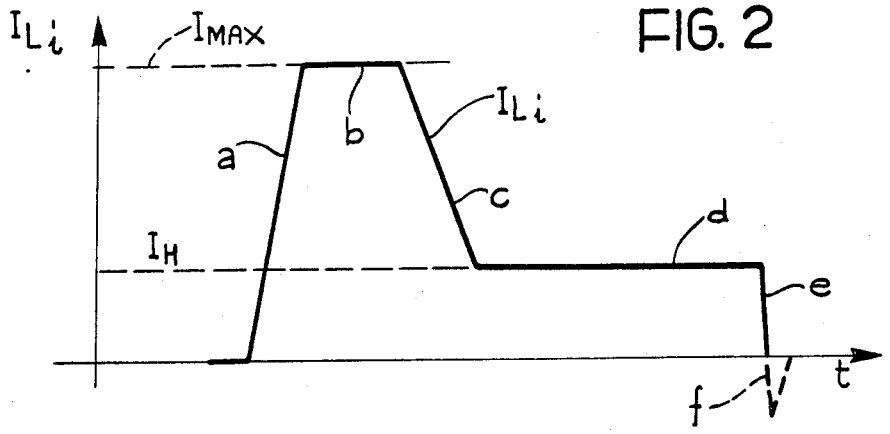
Figure 5:
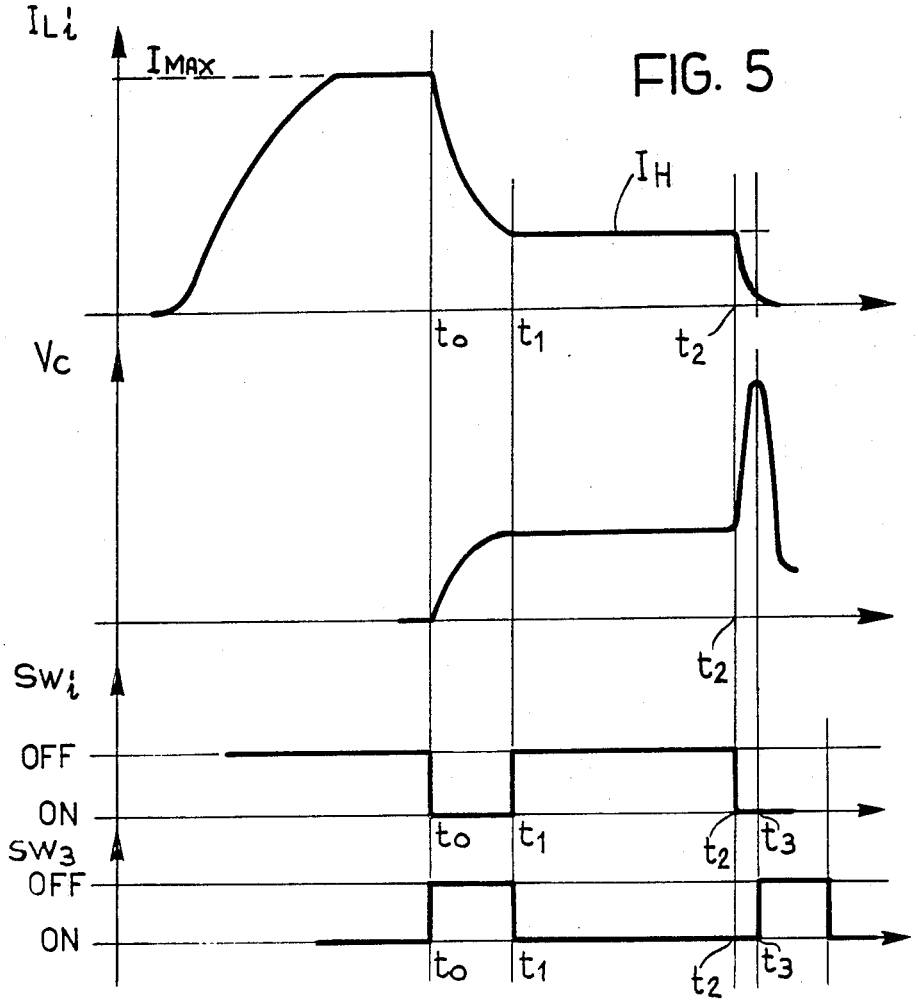
Figure 3:
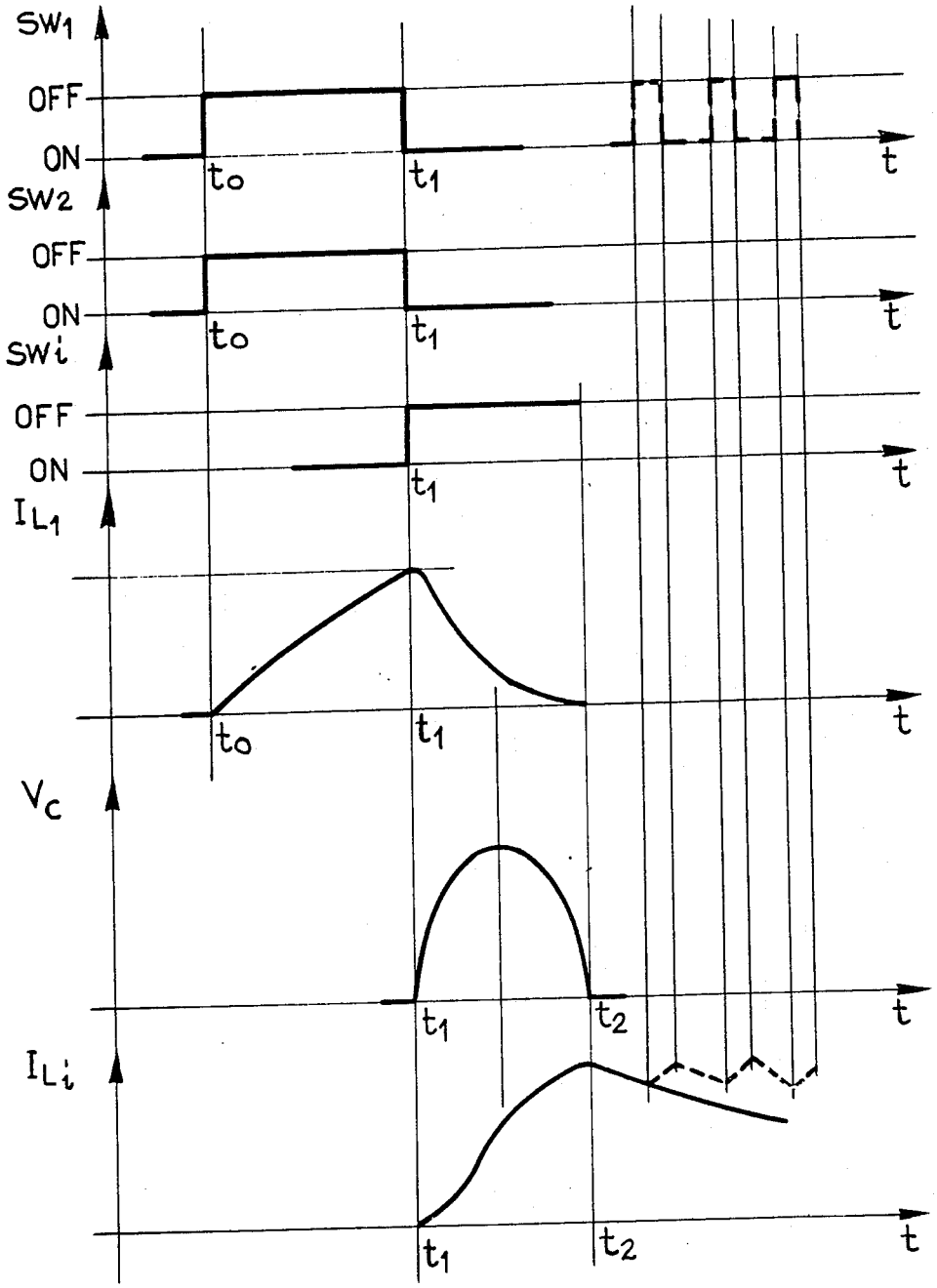
Figure 4:
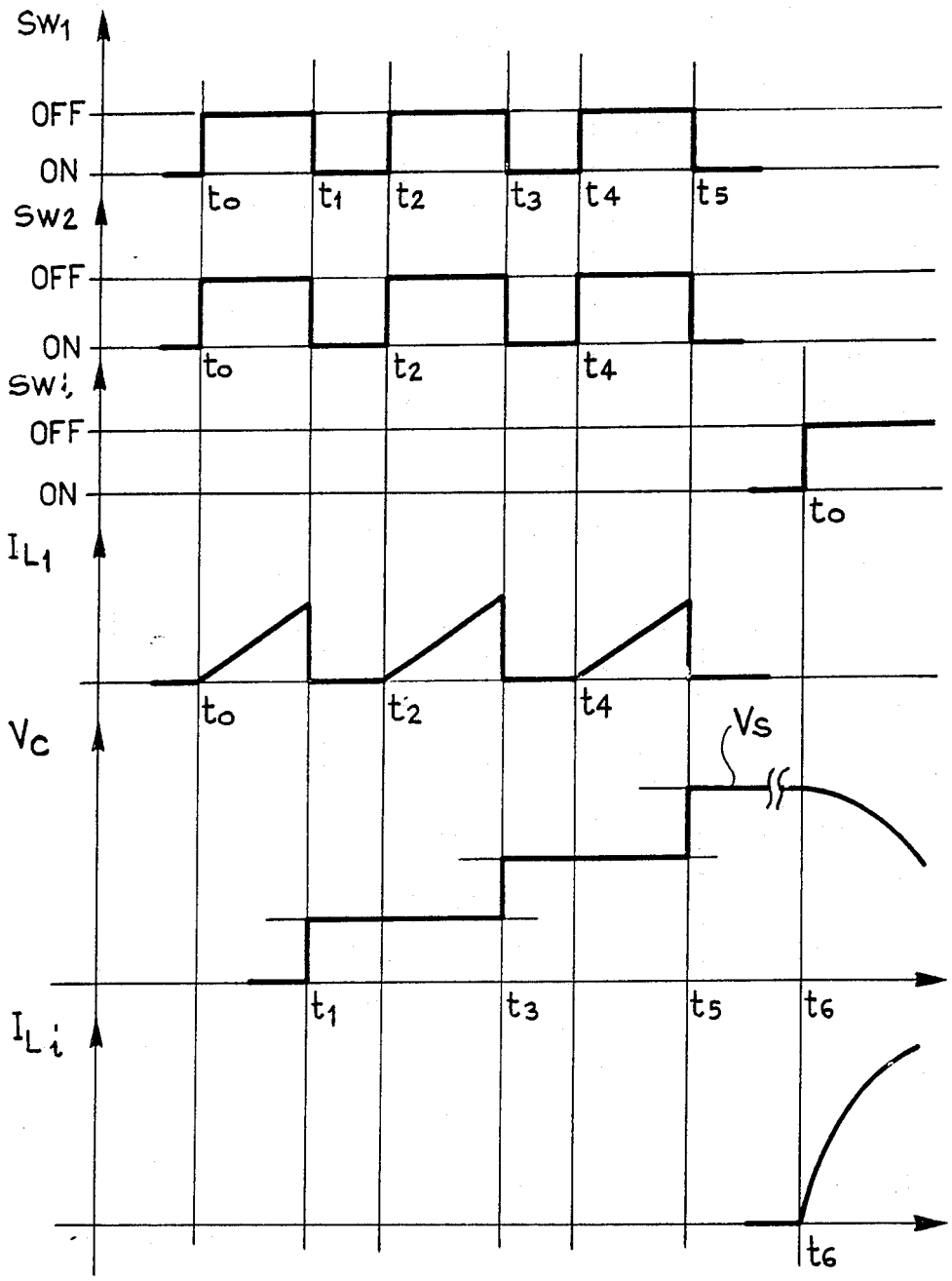

Further characteristics and advantages of the present invention will become clear from the detailed description which follows with reference to the appended drawings, provided by way of non-limiting example, in which:

FIG. 1 is an electrical diagram of a circuit according to the invention, and FIG. 2 is a graph which shows the ideal trace of the excitation current of the solenoid for operating an electro-injector for diesel engines as a function of time, and FIGS. 3 to 5 are three sets of graphs which illustrate states of the devices of the circuit according to the invention and signals developed in the circuit in three different operating conditions.

With reference to FIG. 1, a circuit according to the invention for the piloting of a plurality of inductive loads $L_i$ comprises an input terminal 1 connected in use to a low-tension, direct-voltage supply $V_B$, such as a battery. In particular, the inductive loads $L_i$ may represent the solenoids for operating the electro-injectors of a diesel engine for a motor vehicle. In this case, the supply $V_B$ is constituted by the battery of the motor vehicle.

A storage coil, indicated $L_1$, can be connected to the input terminal 1 through a controlled electronic switch, generally indicated $SW_1$, which is open at rest. The switch $SW_1$ has been shown as an interrupter with which a diode $D_1$ is connected in parallel. This switch may be constituted, for example, by an integrated MOSFET-type transistor, and in that case the diode $D_1$ is constituted by its parasitic diode.

A diode whose anode is connected to earth and whose cathode is connected between the storage coil $L_1$ and the controlled switch $SW_1$ is indicated $R_1$.

A further controlled switch $SW_2$, similar to $SW_1$ is connected between $L_1$ and earth in the manner illustrated.

$L_1$ is connected to a first terminal of a capacitor C whose other terminal is connected to earth. A plurality of branch circuits is connected in parallel with C and each includes an inductive load $L_i$ in series with which a controlled electronic switch $SW_i$ of a similar type to $SW_1$ and $SW_2$ is connected. A respective capacitor $C_i$ may be connected in parallel with each load $L_i$ for quenching it, that is, for rapidly cancelling out the current in the corresponding load $L_i$ when the latter is deactivated.

A resistor and a capacitor, indicated $R_c$ and $C_c$, are connected in parallel with each other between the earth and a junction N to which are connected the cathodes of diodes $D_c$, each of which has its anode connected between a load $L_i$ and the associated controlled switch $SW_i$. The diodes $D_c$ together form an OR-type circuit.

A further controlled switch $SW_4$, similar to the above, is connected between the junction N and the input 1.

An electronic control unit produced in known manner is indicated ECU and comprises, for example, a microprocessor unit and input/output interface circuits. The unit ECU has a series of inputs connected to the earth of the circuit described above, to the positive pole of the supply $V_B$, and to a sensor S which is adapted to provide electrical signals indicative of the current flowing in the storage coil $L_1$ during operation. The sensor S may be constituted, for example, by a Hall-effect sensor. As an alternative to this solution, the non-earth terminal of the capacitor C may be connected to the unit ECU for detecting the current flowing in $L_1$: the voltage established across the terminals of C at particular stages of operation is related to the intensity of the current flowing in $L_1$.

A further alternative solution for the detection of the current flowing in $L_1$ could be constituted, for example, by a shunt resistor connected in series with $L_1$ and connected to the ECU.

The unit ECU has a plurality of outputs connected in order to the control inputs of the switches $SW_1$, $SW_2$, $SW_3$ and $SW_i$.

In order to pilot the electro-injectors of a diesel engine, the unit ECU may be provided with further electrical input signals, such as, for example, the rate of revolution of the engine, etc.

Before describing the operation of the circuit shown in FIG. 1, some considerations concerning the ideal trace of the current $I_{Li}$ in the solenoid for operating an electro-injector for a diesel engine will be put forward. This ideal behaviour is shown in FIG. 2 as a function of time t. The ideal curve illustrated has a rising slope a followed by a stage b of substantially constant high-current intensity $I_{max}$, followed by a transition c towards a holding current level $I_h$. This current is maintained for a certain period of time (section d of the curve) and is then followed by the "quenching" of the current (stage e) with possible inversion and definitive cancelling out of the current (stage f).

For optimal and exact control of the injection it is necessary that the actuation time of individual injectors be precisely controllable. For this purpose, therefore, it is necessary that the times during which the current rises and subsequently falls are extremely short, and less than the minimum injection time by at least one order of magnitude.

With reference to FIGS. 1, 3 and 4, we shall now see how the circuit according to the invention is able to make the current rise rapidly in a particular load each time that load is to be activated.

FIG. 3 shows the states of $SW_1$, $SW_2$ and of the switch $SW_i$ associated with the load $L_i$ to be energised, and the traces of the current $I_{L1}$ in the storage coil, of the voltage $V_C$ across the capacitor C and of the current $I_{Li}$ in the load.

In order to make a current pass into the load $L_i$, the unit ECU causes the switches $SW_1$ and $SW_2$ to close at a time $t_0$. All the other switches remain open. In this condition, an increasing current flows in the storage coil $L_1$, as shown in FIG. 3.

At a subsequent time $t_1$, $SW_1$ and $SW_2$ are opened, whilst the switch $SW_i$ associated with the load to be energised is closed. In this condition, the storage inductor $L_1$ is disconnected from the supply but is connected to the capacitor C with which it forms a resonant circuit. This resonant circuit is discharged to the load $L_i$ associated with the switch $SW_i$ which is closed. The current $I_{Li}$ decays in the manner illustrated, whilst the voltage across the capacitor C(i) increases and then decreases until it reaches zero at a time $t_2$. The current in the selected load therefore increases from the time $t_1$ until it reaches a maximum value at the time $t_2$, and then starts to decay, as shown in FIG. 3. In order to extend the period for which the current persists at high-intensity levels in the load, the unit ECU may be arranged to cause successive openings and closings of $SW_1$ after the time $t_2$, with resultant "chopping" of the current $I_{Li}$, as shown by the broken line in FIG. 3.

The rapid transfer of energy from the supply to the generic load $L_i$ by means of storage in $L_1$ and the consequent discharge of the resonant circuit $L_{1\text{-}C}$ can be achieved, provided that the supply $V_B$ is able to deliver a current of sufficient intensity.

According to the invention, the control unit ECU may be arranged to detect the intensity of the current which can be delivered by the supply. This may be achieved by the acquisition of the signals provided by the sensor S, or by the reading of the voltage across C when $SW_1$ and $SW_2$ are open, or even by the reading of the voltage across a shunt resistor arranged in series with the storage coil $L_1$. When the current delivered by the supply is less than a predetermined value, the unit ECU can also determine (and possibly signal for diagnostic purposes) whether the inadequacy of the current is due to a low charge level of the supply or to an anomaly in the circuitry connected to the supply, by reading the voltage $V_B$ of the supply.

In any case, when the unit ECU detects that the current which can be delivered by the supply is less than a predetermined threshold, it puts into operation a second procedure for the transfer of current to the load $L_i$ selected from time to time. In this procedure, which will now be described with reference to FIGS. 1 and 4, the unit ECU causes successive simultaneous closures of $SW_1$ and $SW_2$, as indicated at the times $t_0$, $t_2$ and $t_4$ in FIG. 4. The switches $SW_3$ and $SW_i$, however, are kept open.

Upon each closure of $SW_1$ and $SW_2$, the current in the storage coil $L_i$ increases until, as at the times $t_1$, $t_3$ and $t_5$, the switches are opened. Upon each opening of $SW_1$ and $SW_2$, the voltage across the capacitor C is increased. The diode $R_2$ prevents the discharge of C during the stage of storage in $L_1$. The diode $P_2$ also serves to protect $SW_2$ when the capacitor C is subsequently discharged.

The voltage across C therefore rises in steps and can be brought to a level greater than that of the supply, until a level $V_S$ is reached (FIG. 4) which is sufficient to cause the rapid passage of a high current to the selected load. This injection of current takes place at the time $t_6$ in FIG. 4 (which, at the limit, may be made to coincide with $t_6$) when the switch $SW_i$ associated with the selected load is closed while all the other switches are open.

The first operating mode of the circuit of FIG. 1, described with reference to FIG. 3, is preferable since it is more convenient from an energy point of view. However, this operating mode is only possible if the supply is able to deliver sufficient current. When this does not occur, the circuit according to the invention nevertheless enables a rapid injection of current to the loads to be achieved by the charging and subsequent discharging of the capacitor C, as described with reference to FIG. 4. The charging of C obviously takes a certain time, which depends on the intensity of the current which can be delivered by the supply. The unit ECU is correspondingly programmed to start the charging of C correspondingly in advance of the time ($t_6$ in FIG. 4) at which the passage of current to the selected load must be triggered.

In practice, the circuit of FIG. 1 requires a single large-capacitance capacitor (the capacitor C) which is used for the injection of the current to the loads $L_i$ in a predetermined sequential order actuated by the unit ECU by means of corresponding sequential piloting of the switches $SW_i$.

Capacitors $C_i$ of considerably smaller capacitance are consequently sufficient to achieve any final inversion of the current in the loads.

Two ways in which the circuit of FIG. 1 can cause a current to pass rapidly into a generic load to achieve the portions a and b of the ideal curve of FIG. 2 have been described above. This current can be made to flow at the desired holding level (section d of the ideal curve shown in FIG. 2) by the opening of the switch $SW_1$ or the switch $SW_i$ associated with the load. In order subsequently to cancel out the current $I_{Li}$ (stage 2) $SW_i$ is opened. In this condition, a voltage is developed across the load which rises to high values in a short time. A clamping circuit is provided for limiting the value of this voltage and is constituted by the capacitor $C_c$ to which the resistor $R_c$ can be connected. It should be noted that this is a single circuit connected to all the loads $L_i$ by means of the diodes $D_c$ which are connected so as to form an OR circuit.

Together with the switch $SW_3$, the "clamping" circuit described above also enables the partial recovery of the reactive energy of the load which is excited from time to time, enabling this energy to be recycled towards the supply $V_B$. This energy recovery, which will now be described, takes place essentially each time a switch $SW_i$ is opened after the injection of current to the associated load L. This can occur essentially in three circumstances, that is, when the current in the load $L_i$ is changed from the maximum level to the holding level (section c of the ideal curve of FIG. 2), when the current in the load is quenched (section of FIG. 2) and, although to a lesser extent, during the stages when the current in the load is being chopped, such as, for example, those described with reference to FIG. 3.

FIG. 5 shows examples of the traces of the current $I_i$ in a load and of the voltage $V_c$ across the clamping capacitor, and the corresponding stages of the switch $SW_i$ associated with the load in question and of the switch $SW_3$. With reference to this Figure, when, at a time $t_0$, $SW_3$ is closed as a result of a command provided by the unit ECU and the switch $SW_i$ associated with the energised load is closed, the current $I_{Li}$ decays, whilst the voltage across the clamping capacitor rises. When the current $I_H$ is reached in the load (a condition which can be detected by the unit ECU, for example, by means of a further Hall-effect sensor associated with $L_i$) at the time $t_1$, the unit ECU causes the switch $SW_i$ which was previously been opened, to close again and opens $SW_3$. In these conditions, the clamping capacitor remains charged at the voltage to which it has previously been brought.

When, at the time $t_2$, the unit ECU subsequently opens $SW_i$, the current in the load decays rapidly, whilst the voltage $V_c$ across the clamping capacitor rises rapidly, as shown in FIG. 5, until the unit ECU closes $SW_3$ at the time $t_3$ and the voltage $V_C$ consequently decreases rapidly.

During the stages when the current in the load which is energised from time to time is decaying, the closure of $SW_3$ enables part of the reactive energy stored in the load to be returned to the supply, by virtue of the concomitant action of the clamping circuit.

This characteristic may be of considerable interest for applications of the circuit according to the invention in the automotive field, particularly in motor cars provided with batteries and/or with relatively low power-recharging systems.

As far as $R_c$ is concerned, this is only necessary (to dissipate the energy stored in $C_c$) if the circuit according to the invention is not arranged to recover the reactive energy. In this case, resistors, each connected in parallel with a diode $D_c$, may be provided in place of $R_c$.

Further possible applications of the circuit according to the invention are, for example, for controlling the relays which scan the punched cards or tapes in Jacquard-type textile machines, for controlling the electro-injectors of an Otto-cycle engine, for controlling the printing heads of matrix printers, etc.

Naturally, the principle of the invention remaining the same, the forms of embodiment and details of construction may be varied widely with respect to those described and illustrated purely by way of non-limiting example, without thereby departing from the scope of the present invention.

What is claimed is:

1. A circuit for the piloting of inductive loads, particularly but not exclusively for operating the electro-injectors of a diesel-cycle internal combustion engine, comprising:

an input for connection to a low-tension supply, a storage coil for storing energy delivered by the supply, and electronic switching means for controlling the connection between the input, the storage coil and each of the loads in a predetermined manner to achieve a rapid transfer of current to each of the loads selectively, wherein it further includes:

a capacitor arranged in parallel with the loads, and connected to the coil and the electronic switching means, and an electronic control unit for piloting the electronic switching means according to a first operative mode in which, to transfer current into one of the loads, the switching means cause in succession, after the connection of the storage coil to the supply, the connection of the storage coil to the capacitor so as to form a resonant circuit, and then the discharge of the resonant circuit into the load.

2. A circuit according to claim 1, further including a current-inversion capacitor in parallel with each load for enabling the current in the corresponding load to be cancelled out rapidly, each inversion capacitor having a smaller capacitance than that of the said capacitor.

3. A circuit according to claim 1, wherein it also includes sensor means for providing electrical signals indicative of the current delivered by the supply, and the control unit is connected to the sensor means and is arranged to pilot the electronic switching means in the first operative mode and in a second operative mode when the current delivered by the supply is greater than and less than a predetermined value, respectively, and wherein the circuit further includes voltage-boosting means, the control unit being adapted to cause the connection of the capacitor to the supply through the voltage-boosting means in the second operative mode, so as to charge the capacitor to a predetermined voltage level greater than the voltage of the supply, and then the discharge of the energy stored in the capacitor into a selected load.

4. A circuit according to claim 3, wherein the sensor means comprise a shunt resistor in series with the storage coil.

5. A circuit according to claim 3, wherein the sensor means comprise a galvanometric-effect sensor.

6. A circuit according to claim 3, wherein the control unit is adapted to detect the voltage across the capacitor.

7. A circuit according to claim 1, including a plurality of branch circuits which are in parallel with each other and each of which includes a load, and in which the electronic switching means comprise a first switch between the supply and the storage coil, a second switch in parallel with the branch circuits, and a control switch in each of the branch circuits, between the corresponding load and the supply, wherein it also includes clamping circuit means for limiting and possibly dissipating the voltage generated by each of the loads when the associated control switch cuts off the current flowing into the load.

8. A circuit according to claim 7, wherein the clamping circuit means comprise a clamping circuit of the parallel-RC type, and the loads are connected to the clamping circuit by means of an OR circuit.

9. A circuit according to claim 1, wherein it also includes energy-recovery circuit means controlled by the unit and adapted to enable part of the reactive energy stored in the load to be recycled towards the supply each time a load is deactivated.

10. A circuit according to claim 1, wherein it includes clamping circuit means for limiting and possibly dissipating the voltage generated by each of the loads when the associated control switch cuts off the current flowing into the load, and energy-recovery circuit means controlled by the electronic control unit and adapted to enable part of the reactive energy stored in the load to be recycled towards the supply each time a load is deactivated, and wherein the recovery circuit means include a further electronic switch connected between the clamping circuit means and the supply and controlled by the electronic control unit.

* * * * *